US008096924B2

(12) United States Patent
Mittelsteadt

(10) Patent No.: US 8,096,924 B2
(45) Date of Patent: Jan. 17, 2012

(54) HAND THERAPY EXERCISE TOOLS, AND METHODS OF CONSTRUCTING AND UTILIZING SAME

(75) Inventor: Carolyn S. Mittelsteadt, Phoenix, AZ (US)

(73) Assignee: Elliott Goldberg, Scarsdale, NY (US)

( * ) Notice: Subject to any disclaimer, the term of this patent is extended or adjusted under 35 U.S.C. 154(b) by 1213 days.

(21) Appl. No.: 11/811,840

(22) Filed: Jun. 12, 2007

(65) Prior Publication Data

US 2008/0312564 A1 Dec. 18, 2008

(51) Int. Cl.
*A63B 23/14* (2006.01)
*A63B 23/16* (2006.01)

(52) U.S. Cl. ..... 482/44; 601/40

(58) Field of Classification Search ..... 482/44–50, 482/92, 148; 601/23, 33, 40
See application file for complete search history.

(56) References Cited

U.S. PATENT DOCUMENTS

| | | | | | |
|---|---|---|---|---|---|
| 4,569,815 | A * | 2/1986 | Rentz et al. | 264/323 |
| 5,427,528 | A * | 6/1995 | Anderson et al. | 434/83 |
| 5,446,075 | A * | 8/1995 | Gibbon | 523/137 |
| 5,472,994 | A * | 12/1995 | Micallef et al. | 523/137 |
| 5,693,689 | A * | 12/1997 | Gibbon | 523/137 |
| 5,755,648 | A * | 5/1998 | Kildani | 482/121 |
| 5,794,627 | A * | 8/1998 | Frantz et al. | 128/848 |
| 5,890,999 | A * | 4/1999 | Kildani | 482/49 |
| 6,454,681 | B1 * | 9/2002 | Brassil et al. | 482/49 |
| 7,618,349 | B1 * | 11/2009 | Muderick | 482/44 |
| 2004/0082886 | A1 * | 4/2004 | Timpson | 601/15 |
| 2009/0111662 | A1 * | 4/2009 | Wagner et al. | 482/45 |
| 2010/0267523 | A1 * | 10/2010 | Wilkinson et al. | 482/45 |

OTHER PUBLICATIONS

Yoder et al., Added-Purpose Versus Rote Exercise in Female Nursing Home Residents, Sep. 1989, vol. 3 No. 9.*

* cited by examiner

*Primary Examiner* — Loan Thanh
*Assistant Examiner* — Daniel Roland
(74) *Attorney, Agent, or Firm* — Irving M. Weiner; Pamela S. Burt; Weiner & Burt, P.C.

(57) ABSTRACT

Hand therapy methods and hand therapy exercise tools used with graded resistance putty to simulate fine/gross motor skills to improve hand/digit/forearm conditions.

29 Claims, 7 Drawing Sheets

Pegs (Set of Ten)

Basic Form: Set of Ten will vary in size by thickness of shaft.

View of Side (1)

View of Side (2)

HAND THERAPY EXERCISE TOOLS, AND METHODS OF CONSTRUCTING AND UTILIZING SAME

CROSS-REFERENCE TO RELATED APPLICATIONS

Not Applicable

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to novel hand therapy exercise tools, and methods of constructing and utilizing same.

More particularly, the present invention relates to the aforementioned tools and methods used in conjunction with therapeutic putty of various resistances Heretofore, a patient may arrive at a hand therapy clinic status-post, for example, a distal radius fracture. Such a patient may have been splinted for six weeks or so. Typically, such a patient has limitations of radial/ulnar deviation, fine motor skills, and functional deficits. Before the advent of the present invention, the tools and techniques available to patient and therapist were limited and not very effective.

The prior, but not necessarily relevant, art is exemplified by:

Smallwood et al. U.S. Pat. No. 5,820,522;

Williams U.S. Pat. No. 6,391,941; and

Minuto et al. US Patent Application Publication US2004/0072653.

The present invention solves the aforementioned problems and other problems.

It is a desideratum of the present invention to avoid the animadversions of conventional hand therapy exercise tools and techniques.

SUMMARY OF THE INVENTION

The present invention provides a hand therapy method, comprising the steps of: providing a first therapeutic putty having a first predetermined resistance; providing a first predetermined hand therapy exercise tool; inserting a first predetermined portion of said tool into first putty; permitting a patient to cause said tool to move a first predetermined trajectory within and relative to said first putty until said patient can do so with ease; removing said tool from said first putty; providing a second therapeutic putty having a second predetermined resistance which is greater than said first predetermined resistance; inserting said first predetermined portion of said tool into said second putty; and permitting the patient to cause said tool to move second predetermined trajectory within and relative to said second putty until said patient can do so with ease.

The present invention also provides a hand therapy exercise tool, comprising, in combination: a tool member having a first predetermined portion having a first predetermined shape and configuration for insertion into a therapeutic putty; said tool member having a second predetermined portion having a second predetermined shape and configuration enabling a patient to manipulate said tool member to cause said tool to move in a predetermined trajectory within and relative to said putty; and said first predetermined shape and configuration of said first portion providing a predetermined resistance to said movement of said tool within and relative to said putty.

It is a primary object of the present invention to provide functional hand exercise equipment.

Another object of the invention is to provide a set of various shaped hand therapy exercise tools which are used with graded resistant putty Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE MENTION

The invention provides novel, various-shaped hand therapy exercise tools 1-13 and methods of using same in treating hand/forearm conditions, such as, for example, tendon lacerations, finger/wrist fractures, finger amputations, carpel tunnel syndrome, tendonitis, arthritis, crush injuries, RSD, etc.

The tools 1-13 are specifically designed to be used with graded-resistant therapeutic putty 14. The putty 14 provides functional simulation with graded resistance during a therapeutic exercise program. The putty 14 comes in various thicknesses which provide various resistances to moving a first predetermined portion 15-41 of the tools 1-13 therein and/or therethrough.

The tools 1-13 provide the patient with functional simulation and graded resistance for various tasks, e.g., opening a door (knob turn), opening a bottle of water (smaller knob turn), work limitations with tightening a bolt, limitations with turning a key, etc.

In describing the tools 1-13 and the various exercises with which they can be used, reference is made hereinbelow to the accompanying drawings and photos together with the text juxtaposed to such photos, which text is incorporated in this detailed description by reference thereto to best facilitate understanding the tools 1-13 and their uses.

Figure 1:
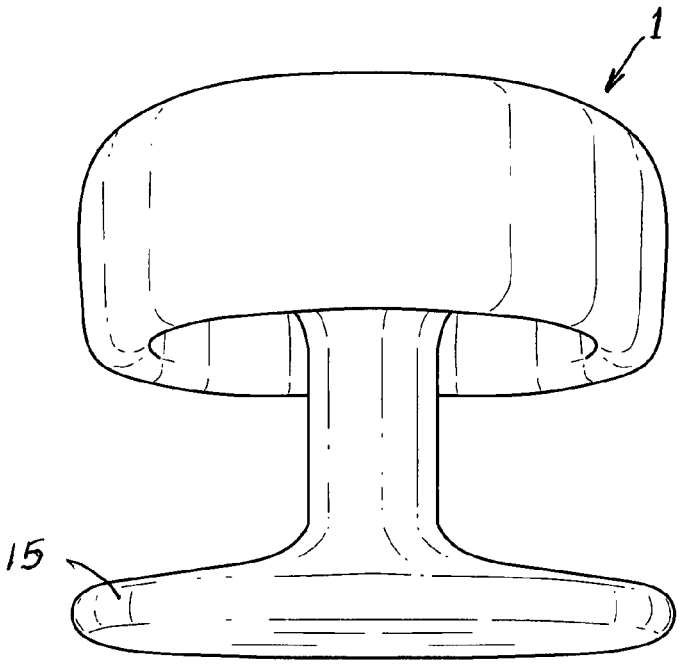
FIG. 1 is a perspective view of a knob turn tool.
Figure 2:
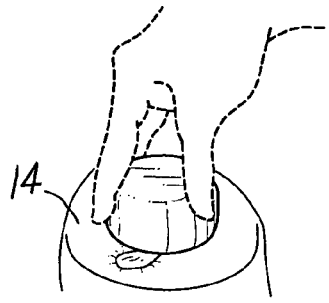
FIG. 2 is shows the FIG. 1 tool being used with fingertips.
Figure 3:
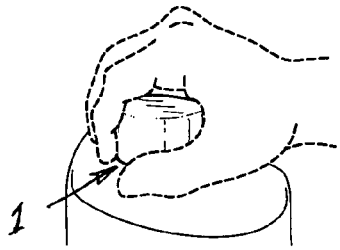
FIG. 3 is shows the FIG. 1 tool being used with the basic grip.

With reference to FIGS. 1-3, there is shown a knob turn tool 1 having a first predetermined portion 15 having a predetermined shape and configuration for insertion into the therapeutic putty 14. The tool 1 can be used to improve various conditions of the hand/forearm as illustrated with reference to FIGS. 1-3. The tool 1 may be made out of a hard plastic. The base 15 is narrowed at the end to aid with moving through the resistant putty 14. The knob shape and size of tool 1 are formed to simulate a basic jar top, lid and doorknob size. Tool 1 may be modified by adding a soft grip surface to increase ease with grasp. Resistance may be graded in by increasing the thickness of putty 14 and by adjusting the speed in which each exercise is performed. The knob turn piece 1 is inserted into the putty 14 by placing it on top of a mound of putty and gently pushing down to insert the base 15 into the resistance. The top portion is then used as a functional exercise to rotate, simulating the activity. The object requires the user to reinsert the object into the putty at various times throughout the exercise to continue having resistance. The exercise time, resistance, and form of exercise is determined by the treating therapist.

Figure 4:
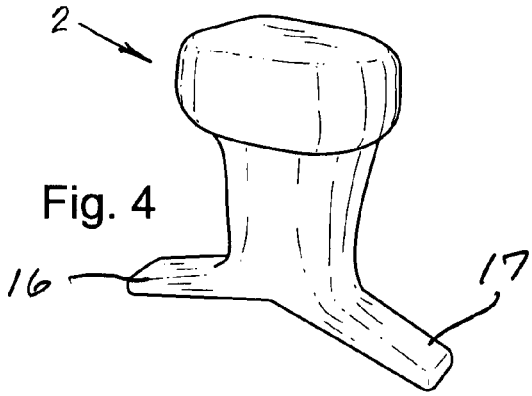
FIG. 4 shows a small knob turn tool.
Figure 5:
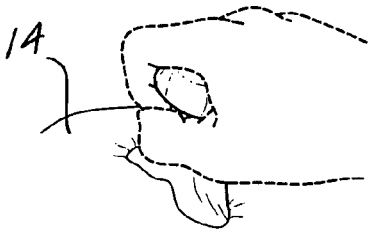
FIG. 5 shows the FIG. 4 tool being used with the basic grip.
Figure 6:
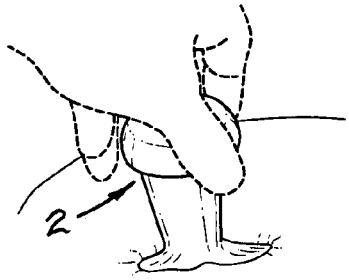
FIG. 6 shows the FIG. 4 tool being used with fingertips.

With reference to FIGS. 4-6, there is shown a small knob turn tool 2 having first predetermined portions 16 and 17 having a predetermined shape and configuration for insertion into the therapeutic putty 14. The tool 2 can be used to improve various conditions of the hand/forearm as illustrated with reference to FIGS. 4-6. Tool 2 may made out of a strong plastic. The small knob shape and size of tool 2 are formed to simulate a basic lid to a bottle, including variations such as a water bottle, a soda bottle, a beer bottle, and a pipe top. Tool 2 may be modified by adding a soft grip surface to increase ease with the grip. Resistance may be graded in by increasing the thickness of putty 14 and by adjusting the speed in which each exercise is performed. The treatment protocol may be determined by the treating therapist. The small knob turn piece 2 is inserted into the putty 14 by placing it on top of a mound of putty and gently pushing down to insert the bases 16 and 17 into the resistance putty 14. The top portion is then used as a functional exercise to rotate/simulate an activity. The object is to require the patient to reinsert tool 2 into the putty at various times throughout the exercise to continue having resistance.

Figure 7:
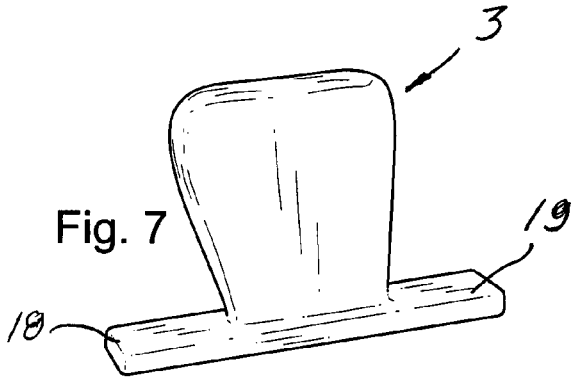
FIG. 7 shows a key turn tool.
Figure 8:
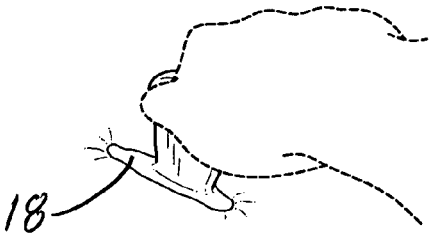
FIG. 8 shows the basic key turn exercise.
Figure 9:
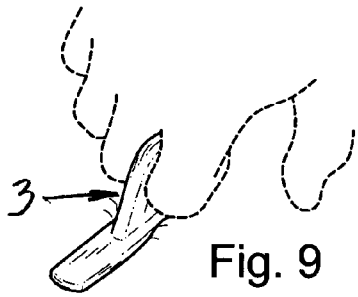
FIG. 9 shows the FIG. 7 tool being used with the intrinsic function between digits.
Figure 10:
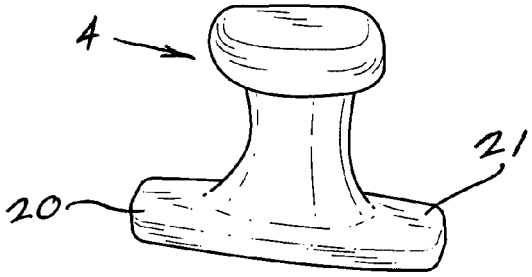
FIG. 10 shows a bolt turn tool.
Figure 11:
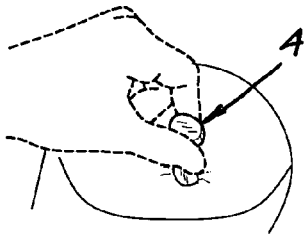
FIG. 11 shows the FIG. 10 tool being used for fine motor skills.
Figure 12:
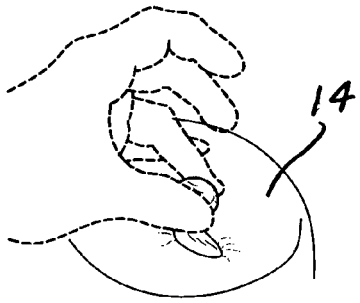
FIG. 12 shows the FIG. 10 tool being used to improve fine motor coordination of individual digits.

With reference to FIGS. 7-9, there is shown a key turn tool 3 having first predetermined portions 18 and 19 having a predetermined shape and configuration for insertion into the therapeutic putty 14. The tool 3 can be used to improve various conditions of the hand/forearm as illustrated with reference to FIGS. 7-9. Tool 3 may be made out of a hard plastic. The bases 18 and 19 are tapered at the ends to ease with moving through the resistant putty 14. The top of tool 3 is shaped to shape and size are smaller to decrease the required force to push the tool 4 through the resistant putty 14. The bolt turn piece 4 is inserted into the putty 14 by placing it on top of a mound of putty and gently pushing down to insert the bases 20 and 21 into the resistance putty 14. The top portion of tool 4 is then used for functional exercises with rotating tool 4 through the resistance putty 14, simulating the activity. The object is to requires the user to reinsert the tool 4 into the putty and rotate it at various times throughout the exercise to continue having resistance. The exercise time, resistance of putty, and form of exercise may be determined by the treating therapist.

Figure 13:
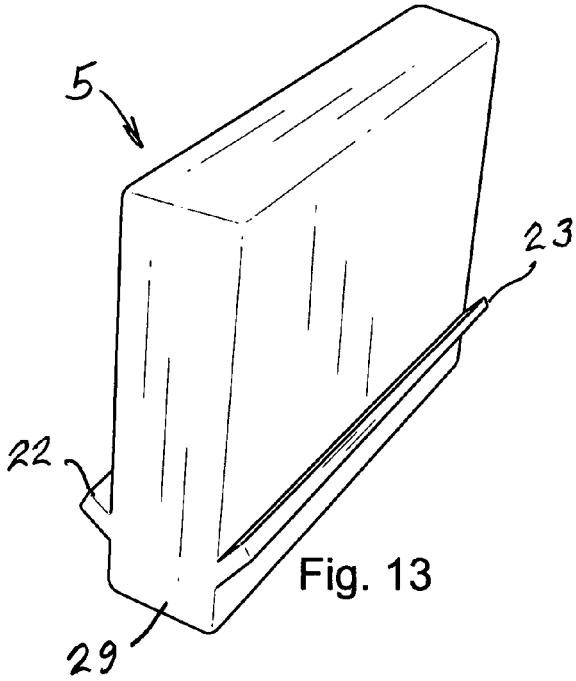
FIG. 13 shows a plank tool.
Figure 14:
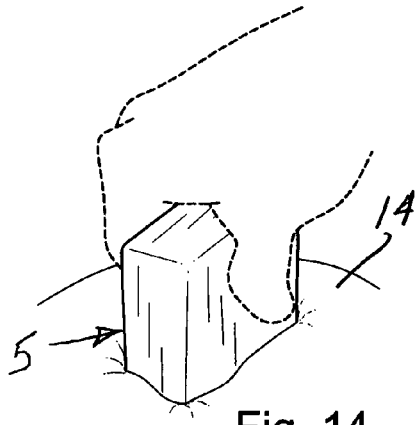
FIG. 14 shows the FIG. 13 tool being used in the intrinsic plus position.

With reference to FIGS. 13 and 14, there is shown a plank tool 5 having first predetermined portions 22, 23 and 29 having a predetermined shape and configuration for insertion into the therapeutic putty 14. The tool 5 can be used to improve various conditions of the hand/forearm as illustrated with reference to FIGS. 13 and 14. Tool 5 may be made out of a hard plastic. Resistance may be graded in by increasing the thickness of putty 14 and by adjusting speed in which each exercise is performed. The purpose of piece 5 is to simulate an intrinsic plus position of the hand. This produces a resistive exercise focusing on the intrinsic muscles of the hand. This can be used to simulate pulling an object out of a resistive substance, picking up an oblong object, rotating an object, and various activities performed throughout the day. Hand therapists may use this exercise to strengthen median and ulnar innervated muscles. The resistance may require the patient to replace the tool 5 in the putty 14 to continue having a resistant exercise. The tool 5 is placed into the putty by pushing/pulling/and/or rotating one end into the putty. The exercise time, resistance, and form of exercise is determined by the treating therapist.

Figure 15:
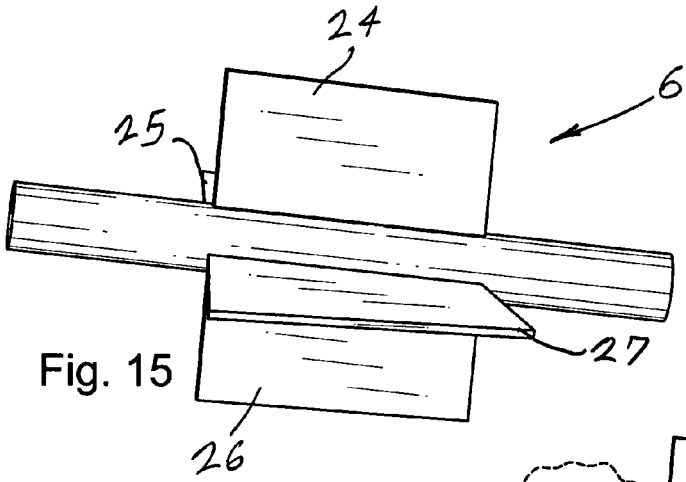
FIG. 15 shows a "T" bar tool.
Figure 16:
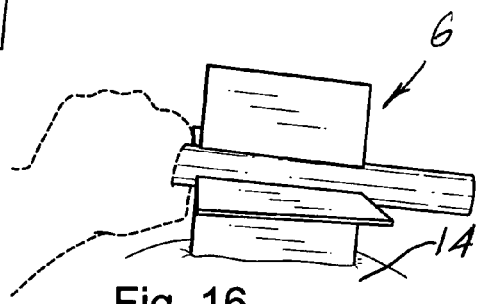
FIG. 16 shows the FIG. 15 tool being used.

With reference to FIGS. 15 and 16, there is shown a "T" bar tool 6 having first predetermined portions 24-27 having a predetermined shape and configuration for insertion into the therapeutic putty 14. The tool 6 can be used to improve various conditions of the hand/forearm as illustrated with reference to FIGS. 15 and 16. The tool 6 may be made out of a hard plastic. The resistance may be graded in by increasing the thickness of putty 14 and by adjusting the speed in which each exercise is performed. Tool 6 is used by gripping one or both ends of the circular bar and placing the extended planks 24-27 into the putty 14. The bar is then rotated forward, backward, or from side to side to create a resistant force. The exercise time, resistance, and form of exercise is determined by the treating therapist.

Figure 17:
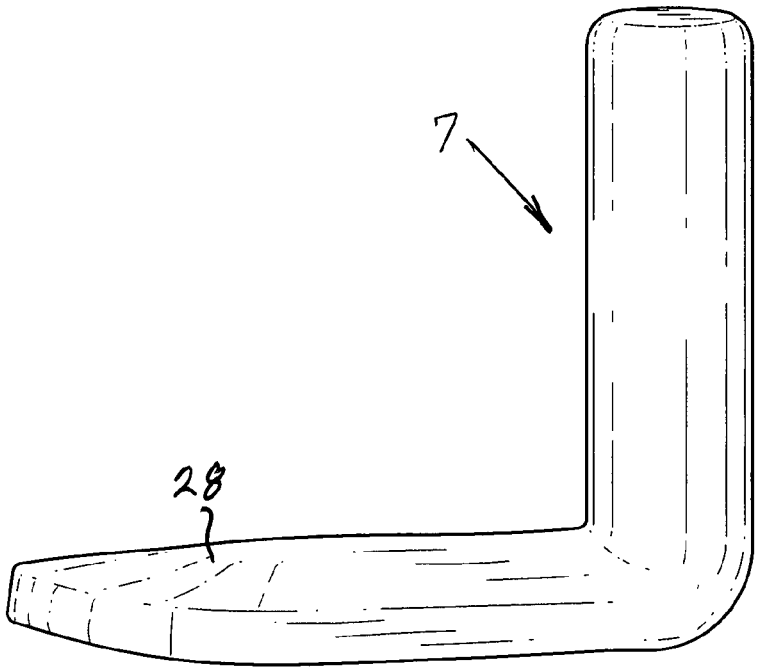
FIG. 17 shows an "L" bar tool.
Figure 18:
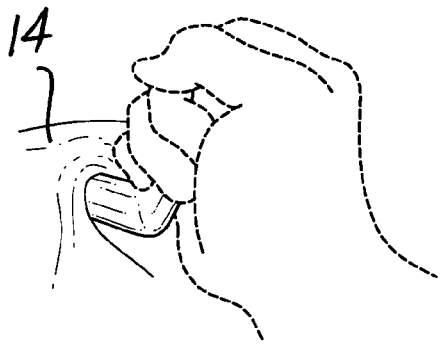
FIG. 18 shows the FIG. 17 tool being used for radial deviation.
Figure 19:
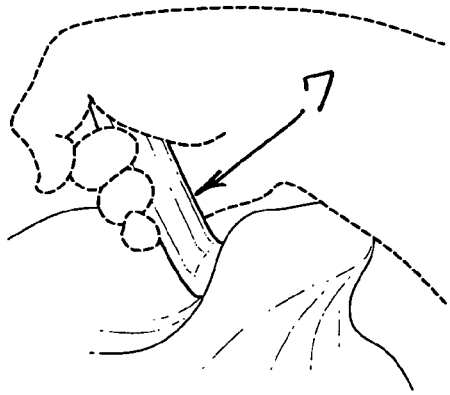
FIG. 19 shows the FIG. 17 tool being used for ulnar deviation.
Figure 20:
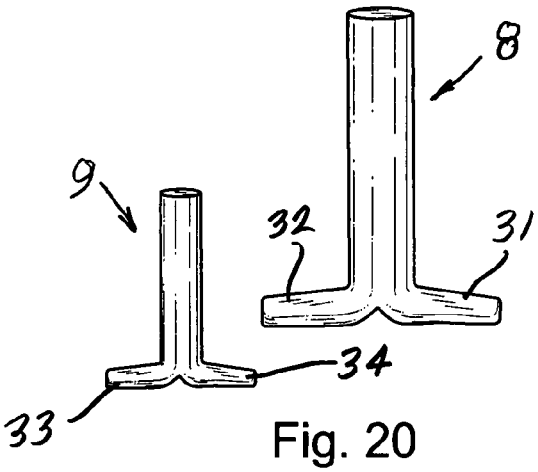
FIG. 20 shows peg tools.
Figure 21:
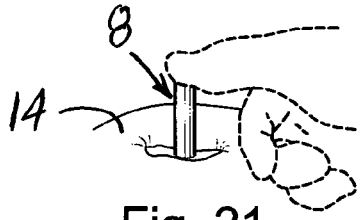
FIG. 21 shows a FIG. 20 tool being pushed down.

With reference to FIGS. 17-19, there is shown an "L" bar tool 7 having a first predetermined portion 28 having a predetermined shape and configuration for insertion into the therapeutic putty 14. The tool 7 can be used to improve various conditions of the hand/forearm as illustrated with reference to FIGS. 17-19. Tool 7 may be made out of a hard plastic. Both ends are tapered to ease with the torque required to move through the resistance putty 14. The "L" form is to allow for exercises to be performed to increase radial and ulnar deviation and forearm pronation and supination. Resistance may be graded in by increasing the thickness of putty 14 and/or by adjusting the speed in which each exercise is performed. The "L" bar 7 is placed into the putty 14 by inserting one end into the putty. The remaining end is used as a lever to pull the inserted end out of the putty. The object is to require the patient to reinsert the tool 7 into the putty at various times throughout the exercise to continue having resistance. The exercise time, resistance, and the form of exercise is determined by the treating therapist.

With reference to FIGS. 20, 21, 30 and 31, there are shown peg tools 8-10 having first predetermined portions 31-34, 40 and 41 having a predetermined shape and configuration for insertion into the therapeutic putty 14. The tools 8-10 can be used to improve various conditions of the hand/forearm as illustrated with reference to FIGS. 20, 21, 30 and 31. Tools 8-10 may made out of a hard plastic. The pegs 8-10 (e.g., a set of ten) are designed in various sizes. The intent is to provide various widths to push/pull pegs 8-10 into putty 14, and also provide turning. Each peg 8-10 has a base 31-34, 40 and 41 which is lengthened and tapered to provide appropriate resistance. Resistance may be graded in by increasing the thickness of the putty 14 and by adjusting the speed at which each exercise is performed. The dimensions of pegs 8-10 may vary to simulate various functional uses. The initial process includes pushing the pegs into the putty to insert the base. The pole of the peg is then used to rotate, pull out, or push further in. The object is to require the patient to insert, rotate, and/or re-insert the peg into the putty at various times throughout the exercise to continue having the desired resistance. The exercise time, resistance, and form of each exercise is determined by the treating therapist.

Figure 22:
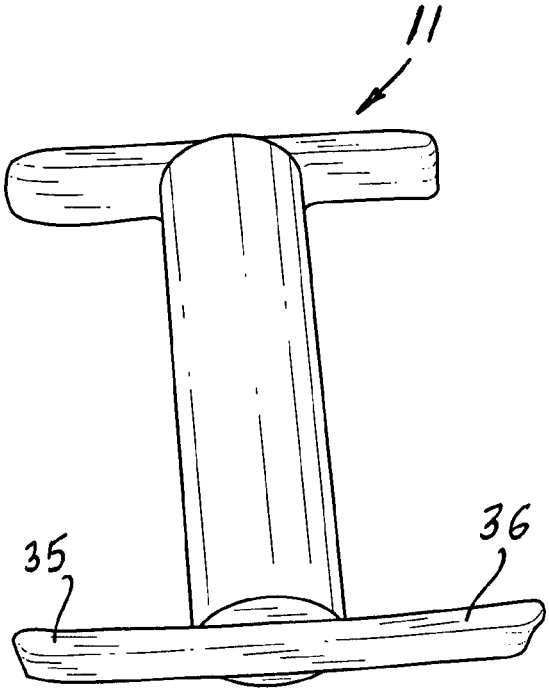
FIG. 22 shows a crank turn tool.
Figure 23:
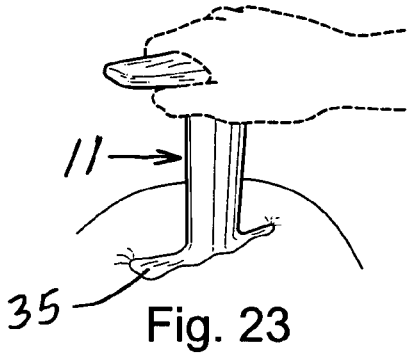
FIG. 23 shows the FIG. 22 tool being used for a top crank turn.
Figure 24:
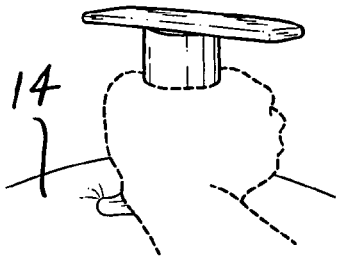
FIG. 24 shows the FIG. 22 tool being used for a sly crank turn.

With reference to FIGS. 22-24, there is shown a crank turn tool 11 having first predetermined portions 35 and 36 having a predetermined shape and configuration for insertion into the therapeutic putty 14. The tool 11 can be used to improve various conditions of the hand/forearm as illustrated with reference to FIGS. 22-24. Tool 11 may be made of a hard plastic. The double "T" form is to simulate turning a bar. The shaft of the crank turn 11 is rounded to simulate a pipe. Resistance may be graded in by increasing thickness of putty 14 and by adjusting speed at which each exercise is performed. The crank turn 11 can be used in various ways, e.g., to insert one base into the putty and simulate a turning/tightening action; to insert one base into the putty and grip the shaft to produce a rotating action; to hold onto the shaft and place one base into the putty and produce a rotating action; etc. The object is to require the patient to insert, rotate, and/or re-insert the tool 11 into the putty at various times throughout the exercise to continue having resistance. The exercise time, resistance, and form of each exercise is determined by the treating therapist.

Figure 25:
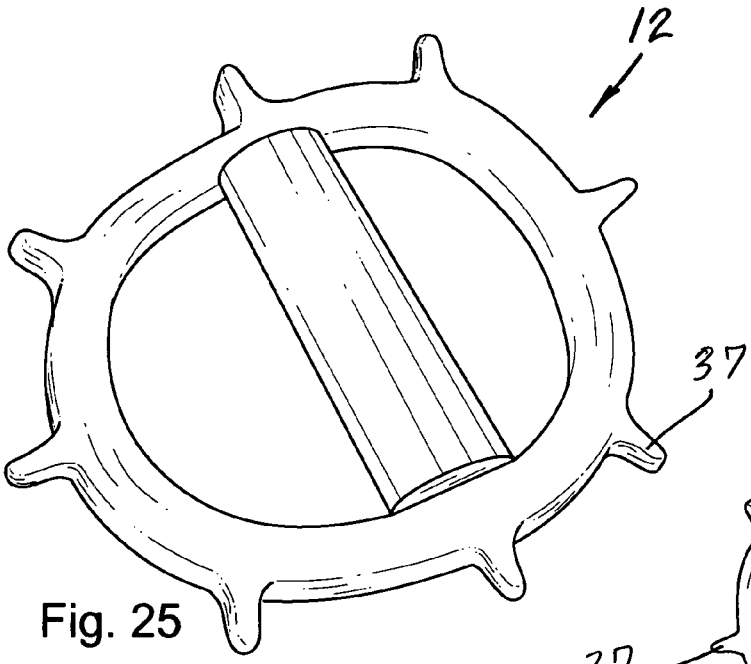
FIG. 25 shows a pro/sup wheel tool.
Figure 26:
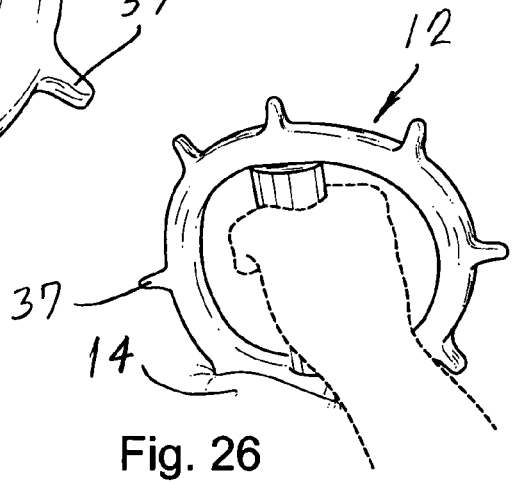
FIG. 26 shows the FIG. 25 tool being used for forearm pronation.

With reference to FIGS. 25 and 26, there is shown a pro/sup wheel tool 12 having first predetermined portions 37 having a predetermined shape and configuration for insertion into the therapeutic putty 14. The tool 12 can be used to improve various conditions of the hand/forearm as illustrated with reference to FIGS. 25 and 26. Tool 12 may made of a hard plastic, and formed as an oval to increase the time of resistance during rotation. The center bar of tool 12 is a round mass to simulate a gripping activity. Resistance may be graded in by increasing thickness of putty 14 and by adjusting the speed in which each exercise is performed. The spikes 37 of the tool 12 are inserted into the putty to provide resistance. The forearm is then rotated to produce a supination and/or pronation activity. This activity can simulate opening of a door, tightening of an object, and many other functional activities. The purpose is to require the patient to insert, rotate, and/or re-insert tool 12 into the putty 14 at various times throughout each exercise to continue having resistance. The exercise time, resistance, and form of each exercise is determined by the treating therapist.

Figure 27:
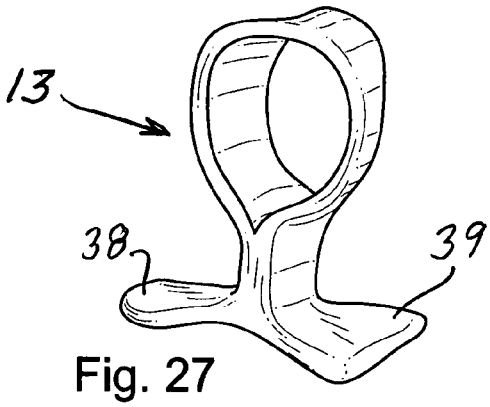
FIG. 27 shows a digit extension loop tool.
Figure 28:
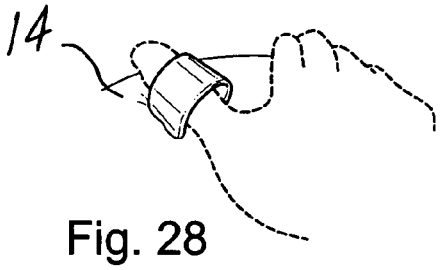
FIG. 28 shows the FIG. 27 tool being used for extensor pollicis longus isolation.
Figure 29:
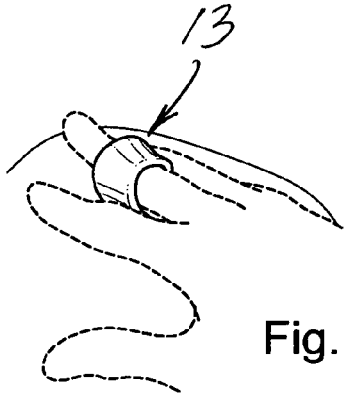
FIG. 29 shows the FIG. 27 tool being used for digit extension.
Figure 31:
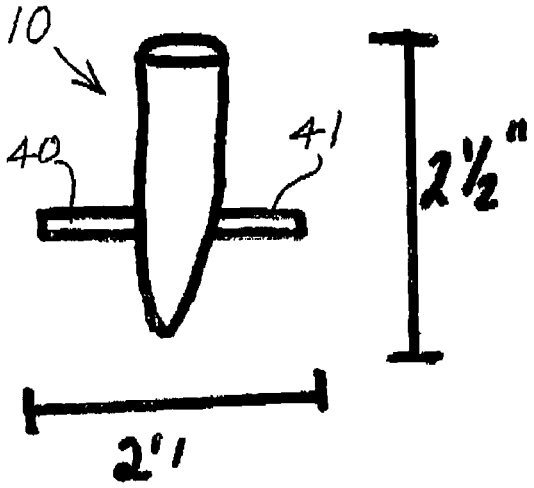
FIGS. 30 and 31 show a different embodiment of the FIG. 20 tools.
Figure 30:
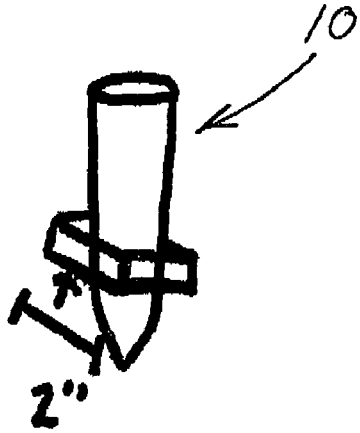

With reference to FIGS. 27-29, there is shown a digit extension loop tool 13 including first predetermined portions 38 and 39 having a predetermined shape and configuration for insertion into the therapeutic putty 14. The tool 13 can be used to improve various conditions of the digits/hand as illustrated with reference to FIGS. 27-29. Tool 13 may be made out of a hard plastic. The shape of tool 13 is formed to allow a digit to be inserted through a loop to provide a resistance with digit extension. The base 38 and 39 is in a "T" formation to grip into the putty 14 to provide resistance. The width of the loop is wide to accommodate to various sizes of digits. Resistance may be graded in by increasing the thickness of putty 14 and/or by adjusting the speed at which each exercise is performed. The base of tool 13 is pushed down into the putty to provide a resistance. The digit of choice is placed through the loop of tool 13. The digit is then extended to produce a movement of extension. The purpose is to require the patient to insert and re-insert tool 13 into the putty at various times throughout the exercise to continue having resistance. The exercise time, resistance, and form of exercise is determined by the treating therapist.

The putty 14 is provided in various resistances, e.g., soft, medium, medium-hard, hard. The tools 1-13 used in conjunction with the graded resistance putty 14 enables the patient to progress gradually with the therapy methods and exercise programs in accordance with the invention.

The invention provides a cost-effective, multi-functional group of fine/gross motor exercise equipment (tools 1-13) and unique methods of using same for clinic use. These can also be purchased by the patient to include into their home exercise program.

There have been illustrated in the accompanying drawings and described hereinabove only several of the unique and novel embodiments of the present invention which can be practiced and constructed in many different configurations, arrangements of components, sizes, shapes, and exercises therewith.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A hand/forearm therapy method, comprising the steps of:

providing a first therapeutic putty having a first predetermined resistance;

providing a first predetermined hand/forearm therapy exercise tool;

inserting a first predetermined portion of said tool directly into said first putty so that said first predetermined portion touches and is immersed in said first putty;

moving said tool to move a first predetermined trajectory within and relative to said first putty;

removing said tool from said first putty;

providing a second therapeutic putty having a second predetermined resistance which is greater than said first predetermined resistance;

inserting said first predetermined portion of said tool directly into said second putty so that said first predetermined portion touches and is immersed in said second putty; and moving said tool to move a second predetermined trajectory within and relative to said second putty.

2. A method according to claim 1, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

3. A method according to claim 1, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

4. A hand/forearm therapy method, comprising the steps of:

providing a first therapeutic putty having a first predetermined resistance;

providing a first predetermined hand/forearm therapy exercise tool;

inserting a first predetermined portion of said tool into said first putty;

moving said tool to move a first predetermined trajectory within and relative to said first putty;

removing said tool from said first putty;

providing a second therapeutic putty having a second predetermined resistance which is greater than said first predetermined resistance;

inserting said first predetermined portion of said tool into said second putty;

moving said tool to move a second predetermined trajectory within and relative to said second putty;

after the user has caused said tool to move said second predetermined trajectory within and relative to said second putty, removing said tool from said second putty;

providing a third therapeutic putty having a third predetermined resistance which is greater than said second predetermined resistance;

inserting said first predetermined portion of said tool into said third putty; and moving said tool to move a third predetermined trajectory within and relative to said third putty.

5. A method according to claim 4, wherein after the user first places the tool into the first putty and moves it a predetermined trajectory, then places the tool into the second putty and moves it a predetermined trajectory, and then repeats the steps and this time progressively increases the depth of insertion.

6. A method according to claim 4, wherein after the user first places the tool into the first putty and moves it a predetermined trajectory, then places the tool into the second putty and moves it a predetermined trajectory, then places the tool into the third putty and moves it a predetermined trajectory, and then repeats the steps and this time progressively increases the depth of insertion.

7. A method according to claim 4, wherein after the user first places the tool into the first putty and moves it a predetermined trajectory, the user then progressively increases the depth of insertion, and then places the tool into the second putty and moves it a predetermined trajectory, and then progressively increases the depth of insertion.

8. A method according to claim 4, wherein after the user first places the tool into the first putty and moves it a predetermined trajectory, the user then progressively increases the depth of insertion, and then places the tool into the second putty and moves it a predetermined trajectory, and then progressively increases the depth of insertion; and then places the tool into the third putty and moves it a predetermined trajectory, and then progressively increases the depth of insertion.

9. A method according to claim 4, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

10. A method according to claim 4, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

11. A method according to claim 5, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

12. A method according to claim 5, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

13. A method according to claim 6, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

14. A method according to claim 6, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

15. A hand/forearm therapy method, comprising the steps of:

providing a first therapeutic putty having a first predetermined resistance;

providing a first predetermined hand/forearm therapy exercise tool;

inserting a first predetermined portion of said tool into said first putty;

moving said tool to move a first predetermined trajectory within and relative to said first putty;

removing said tool from said first putty;

providing a second therapeutic putty having a second predetermined resistance which is greater than said first predetermined resistance;

inserting said first predetermined portion of said tool into said second putty;

moving said tool to move a second predetermined trajectory within and relative to said second putty;

wherein after the user first places the tool into the first putty and moves it a predetermined trajectory, then places the tool into the second putty and moves it a predetermined trajectory, and then repeats the steps and this time progressively increases the depth of insertion.

16. A method according to claim 15, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

17. A method according to claim 15, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

18. A hand/forearm therapy method, comprising the steps of:

providing a first therapeutic putty having a first predetermined resistance;

providing a first predetermined hand/forearm therapy exercise tool;

inserting a first predetermined portion of said tool into said first putty;

moving said tool to move a first predetermined trajectory within and relative to said first putty;

removing said tool from said first putty;

providing a second therapeutic putty having a second predetermined resistance which is greater than said first predetermined resistance;

inserting said first predetermined portion of said tool into said second putty;

moving said tool to move second predetermined trajectory within and relative to said second putty;

wherein after the user first places the tool into the first putty and moves it a predetermined trajectory, the user then progressively increases the depth of insertion, and then places the tool into the second putty and moves it a predetermined trajectory, and then progressively increases the depth of insertion.

19. A method according to claim 18, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

20. A method according to claim 18, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

21. A hand/forearm therapy method to provide an exercise for a patient by a treating therapist, comprising the steps of:

providing a first therapeutic putty having a first predetermined resistance;

providing a first predetermined hand/forearm therapy exercise tool;

inserting a first predetermined portion of said tool into said first putty;

moving said tool to move a first predetermined trajectory within and relative to said first putty;

removing said tool from said first putty;

reinserting the tool into the first putty at various times to continue increasing the resistance to moving the tool therein;

providing a second therapeutic putty having a second predetermined resistance which is greater than said first predetermined resistance;

inserting said first predetermined portion of said tool into said second putty;

moving said tool to move a second predetermined trajectory within and relative to said second putty;

removing the tool from said second putty; and reinserting the tool into the second putty at various times to continue increasing the resistance to moving the tool therein.

22. A method according to claim 21, wherein:

after the patient has caused said tool to move said second predetermined trajectory within and relative to said second putty, removing said tool from said second putty;

providing a third therapeutic putty having a third predetermined resistance which is greater than said second predetermined resistance;

inserting said first predetermined portion of said tool into said third putty; and moving said tool to move a third predetermined trajectory within and relative to said third putty.

23. A method according to claim 22, including the steps of:

removing the tool from said third putty; and reinserting the tool into the third putty at various times to continue increasing the resistance to moving the tool therein.

24. A method according to claim 21, including the step of:

mimicking a functional task, such as turning a door knob, opening a bottle cap, inserting and turning a key, turning and tightening a nut, and turning and tightening a bolt.

25. A method according to claim 21, wherein:

exercise time, resistance, and form of exercise is determined by the treating therapist.

26. A method according to claim 21, wherein:

the type of said predetermined hand/forearm therapy exercise tool is determined by the treating therapist.

27. A method according to claim 21, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to strengthen one or more muscles associated with the hand/forearm of the user, and/or to increase radial and ulnar deviation and forearm pronation and supination.

28. A method according to claim 21, including the step of:

selecting said second predetermined portion of the tool from a group consisting of a shape of a bolt, a nut, a bottle cap, a key, a door knob, a peg, a digit extension loop, a pro/sup wheel, a crank, a plank, a "T" bar, and an "L" bar to permit the user to mimic a functional task, such as turning a door knob, opening a bottle cap, inserting and turning a key, turning and tightening a nut, and turning and tightening a bolt.

29. A hand/forearm therapy method, comprising the steps of:

providing a first therapeutic putty having a first predetermined resistance;

providing a first predetermined hand/forearm therapy exercise tool having a first predetermined portion having a first predetermined shape and configuration for insertion into said first therapeutic putty, and a second predetermined portion having a second predetermined shape and configuration enabling the user to manipulate the tool to cause said tool to move in a predetermined trajectory within and relative to said putty, and said first predetermined shape and configuration of said first portion providing a predetermined resistance to movement of said tool within and relative to said first putty;

inserting said first predetermined portion of said tool into said first putty;

moving said tool to move a first predetermined trajectory within and relative to said first putty removing said tool from said first putty;

providing a second therapeutic putty having a second predetermined resistance which is greater than said first predetermined resistance;

inserting said first predetermined portion of said tool into said second putty; and moving said tool to move a second predetermined trajectory within and relative to said second putty.

* * * * *